US009438000B2

(12) United States Patent
Kato et al.

(10) Patent No.: US 9,438,000 B2
(45) Date of Patent: Sep. 6, 2016

(54) SHIELD CONNECTOR FOR A SHIELD CABLE

(71) Applicant: YAZAKI CORPORATION, Minato-ku, Tokyo (JP)

(72) Inventors: Hajime Kato, Kakegawa (JP); Hiroshi Shinba, Ohta-ku (JP)

(73) Assignee: YAZAKI CORPORATION, Tokyo (JP)

( * ) Notice: Subject to any disclaimer, the term of this patent is extended or adjusted under 35 U.S.C. 154(b) by 93 days.

(21) Appl. No.: 14/226,266

(22) Filed: Mar. 26, 2014

(65) Prior Publication Data

US 2014/0206232 A1 Jul. 24, 2014

Related U.S. Application Data

(63) Continuation of application No. PCT/JP2012/006153, filed on Sep. 6, 2012.

(30) Foreign Application Priority Data

Sep. 27, 2011 (JP) ..... 2011-210890

(51) Int. Cl.

| | |
|---|---|
| ***H01R 9/03*** | (2006.01) |
| ***H01R 43/20*** | (2006.01) |
| ***H01R 9/05*** | (2006.01) |
| ***H01R 13/502*** | (2006.01) |

(Continued)

(52) U.S. Cl.

CPC ..... *H01R 43/20* (2013.01); *H01R 9/037* (2013.01); *H01R 9/0518* (2013.01); *H01R 13/502* (2013.01); *H01R 13/6581* (2013.01); *H01R 13/6592* (2013.01); *H01R 13/6593* (2013.01); *Y10T 29/49174* (2015.01)

(58) Field of Classification Search

CPC ..... H01R 13/6272; H01R 13/6275; H01R 13/6581; H01R 13/659; H01R 9/037

USPC ..... 439/607.5, 607.48, 607.52, 607.55, 439/607.41, 607.45, 607.24

See application file for complete search history.

(56) References Cited

U.S. PATENT DOCUMENTS

| | | | | |
|---|---|---|---|---|
| 7,534,138 | B1 * | 5/2009 | Gump et al. | 439/564 |
| 8,790,137 | B2 * | 7/2014 | Deno et al. | 439/607.41 |

(Continued)

FOREIGN PATENT DOCUMENTS

| | | |
|---|---|---|
| CN | 201303150 Y | 9/2009 |
| EP | 1 689 046 A1 | 8/2006 |

(Continued)

OTHER PUBLICATIONS

International Search Report of PCT/JP2012/006153 dated Jan. 25, 2013.

(Continued)

*Primary Examiner* — Chandrika Prasad
*Assistant Examiner* — Harshad Patel
(74) *Attorney, Agent, or Firm* — Sughrue Mion, PLLC

(57) ABSTRACT

A shell of a female connector includes two members including a shell body integrated with a female housing and a braided wire fixing member to which a braided wire of a shield cable is crimped and fixed. The braided wire fixing member to which the braided wire is crimped and fixed is mated with a cylindrical portion of the shell body integrated with the female housing.

2 Claims, 7 Drawing Sheets

(51) Int. Cl.

| | |
|---|---|
| ***H01R 13/6581*** | (2011.01) |
| ***H01R 13/6592*** | (2011.01) |
| ***H01R 13/6593*** | (2011.01) |

(56) References Cited

U.S. PATENT DOCUMENTS

| | | | | |
|---|---|---|---|---|
| 2004/0106325 | A1* | 6/2004 | Miyazaki | 439/607 |
| 2004/0259421 | A1* | 12/2004 | Lai | 439/610 |
| 2005/0215122 | A1 | 9/2005 | Nishida | |
| 2009/0093159 | A1 | 4/2009 | Aoki et al. | |
| 2009/0260232 | A1 | 10/2009 | Aoki et al. | |
| 2012/0058674 | A1* | 3/2012 | Deno et al. | 439/607.52 |

FOREIGN PATENT DOCUMENTS

| | | | |
|---|---|---|---|
| JP | 2005-276630 | A | 10/2005 |
| JP | 2006-216331 | A | 8/2006 |
| JP | 2009-087902 | A | 4/2009 |
| JP | 2010-541182 | A | 12/2010 |
| WO | 2010/131772 | A1 | 11/2010 |

OTHER PUBLICATIONS

Communication dated Jun. 23, 2015 from the Japanese Patent Office in counterpart application No. 2014-531397.

Communication dated Jul. 9, 2015 from the State Intellectual Property Office of the P.R.C. in counterpart application No. 201280047387.5.

Communication dated Feb. 16, 2016 from the European Patent Office issued in corresponding Application No. 12787122.6.

Communication dated Dec. 1, 2015 from the Japanese Patent Office issued in counterpart Japanese application No. 2014-531397.

* cited by examiner

SHIELD CONNECTOR FOR A SHIELD CABLE

CROSS REFERENCE TO RELATED APPLICATION

This is a continuation application based on PCT application No. PCT/JP2012/006153 filed on Sep. 26, 2012, which claims the benefit of priority from Japanese Patent Application No. 2011-210890 filed on Sep. 27, 2011, the entire contents of which are incorporated by reference herein.

BACKGROUND OF THE INVENTION

1. Field of the Invention

The present invention relates to a shield connector mounted to terminals of two shield cables and a method of assembling the shield connector.

2. Description of the Related Art

A shield connector is mounted to terminals of two shield cables for handling a high voltage of an electric vehicle (EV), a hybrid electric vehicle (HEV) or the like and is used for connecting the two shield cables. A connector housing of each connector of this shield connector has a conductive shell which is connected to a braided wire of one shield cable. The shell has a first end portion configured to have a contact with the shell of the mating housing by having its own connector mated with the mating connector. The first end portion of each of the shells serves as a high-frequency shield in the entirety of the own connector and the mating connector mated with each other.

The structure for connecting the shell with the braided wire in each of the connectors differs with the type of the shield connector. As an example of such structure, a method is given in which a braided wire is expanded to be disposed on an outer periphery at a second end portion of the shell and the braided wire is crimped and fixed to the shell from outside a collective entity of the shell and braided wire by using a crimping member in a form of a ring (for example, refer to PTL 1: Japanese Patent Application Laid-Open Publication No. 2009-87902).

Two methods are given for crimping and fixing the braided wire to the shell in each of the connectors. In the first method, firstly the shell is mounted to the connector housing and subsequently the braided wire is crimped and fixed to the shell. In this case, a force applied to the shell at the crimping may be applied, as a stress, to a housing portion positioned inside the shell, thereby the connector housing may be deformed.

In the second method, firstly the braided wire is crimped and fixed to the shell and subsequently the shell is mounted to the connector housing. In this case, in a state in which the weight of the shield cable connected to the shell is applied, the thin shell is to be inserted into and mounted to a shell mounting portion of the connector housing. Thus, at the time of inserting the shell, it is necessary to make a delicate inserting operation while enduring the weight of the shield cable so as to prevent the shell from causing a flexural deformation due to hooking of the shell with the shell mounting portion.

SUMMARY OF THE INVENTION

It is an object of the present invention to provide a shield connector and a method of assembling the shield connector which are capable of easily mounting the shell to the connector housing and are capable of easily crimping and fixing the braided wire to the shell without deforming the connector housing and without making a delicate inserting operation while enduring the weight of the shield cable.

According to a first aspect of the present invention, there is provided a shield connector to be mounted to a terminal of a multiple-core shield cable having a plurality of electric wires covered with a braided wire, the shield connector including: a housing for receiving a terminal to be connected with a terminal of each of the electric wires; and a conductive shell mounted to the housing and to which the braided wire is to be crimped and fixed, wherein the shell includes: a cylindrical braided wire fixing member to which the braided wire is to be crimped and fixed, and a shell body configured to be separated from the braided wire fixing member and provided to be integrated with the housing, the shell body having a cylindrical fixing member mating portion with which the braided wire fixing member is mated.

According to the first aspect of the present invention, in the shell of the shield connector, the shell body provided to be integrated with the housing of the shield connector is separated from the braided wire fixing member to which the braided wire is crimped and fixed. Thus, with respect to the shell body, it is not necessary to mount the shell body to the housing while enduring the weight of the multiple-core shield cable in a state in which the multiple-core shield cable is connected with the shell body via the braided wire. Therefore, the light-weight shell body alone can accomplish the mounting to the housing which mounting needs to be implemented without causing a damage such as flexural deformation to the shell body.

Further, with respect to the braided wire fixing member, it is possible to crimp and fix the braided wire to the braided wire fixing member in a state in which the braided wire fixing member is separated from the housing such that no stress is applied to the housing. Further, thereafter, mating the braided wire fixing member (which is connected with the multiple-core shield cable) with the fixing member mating portion of the shell body can be more simplified than the operation of mounting the conventional shell to the housing since the positioning accuracy and the like to the mounting target portion can be lowered.

To summarize the above, without deforming the housing, the shell can be mounted to the connector housing simply and easily and the braided wire can be crimped and fixed to the shell simply and easily.

According to a second aspect of the present invention, at least one member of the braided wire fixing member and the fixing member mating portion is provided with a contact for securing an electrical conduction between the braided wire fixing member and the fixing member mating portion by elastically abutting the other member of the braided wire fixing member and the fixing member mating portion in a state that the braided wire fixing member is mated with the fixing member mating portion.

According to the second aspect of the present invention, mating the braided wire fixing member with the fixing member mating portion allows the contact of at least one member of the braided wire fixing member and the fixing member mating portion to elastically abut the other member of the braided wire fixing member and the fixing member mating portion to thereby secure the electrical conduction between the braided wire fixing member and the fixing member mating portion. Thus, even when a slight gap is defined between the braided wire fixing member and the fixing member mating portion, the electrical conduction between the braided wire fixing member and the fixing member mating portion can be reliably secured.

According to a third aspect of the present invention, there is provided a method of assembling the shield connector according to the first aspect of the present invention, the method including: crimping and fixing the braided wire to the braided wire fixing member; and mating the braided wire fixing member, to which the braided wire is crimped and fixed, with the fixing member mating portion of the shell body provided to be integrated with the housing.

According to the third aspect of the present invention, implementing the mating operation after the crimping and fixing operation accomplishes, without deforming the housing, that mounting the shell to the connector housing can be implemented simply and easily and crimping and fixing the braided wire to the shell can be implemented simply and easily. Thus, the shell having such a structure that the shell body is separated from the braided wire fixing member can more preferably accomplish the method of assembling the shield connector.

With the shield connector and the method of assembling the shield connector according to the present invention, it is possible to simply and easily mount the shell to the connector housing and simply and easily crimp and fix the braided wire to the shell, without deforming the connector housing and without making a delicate inserting operation into the connector housing while enduring the weight of the shield cable.

DESCRIPTION OF THE EMBODIMENTS

Figure 1A:
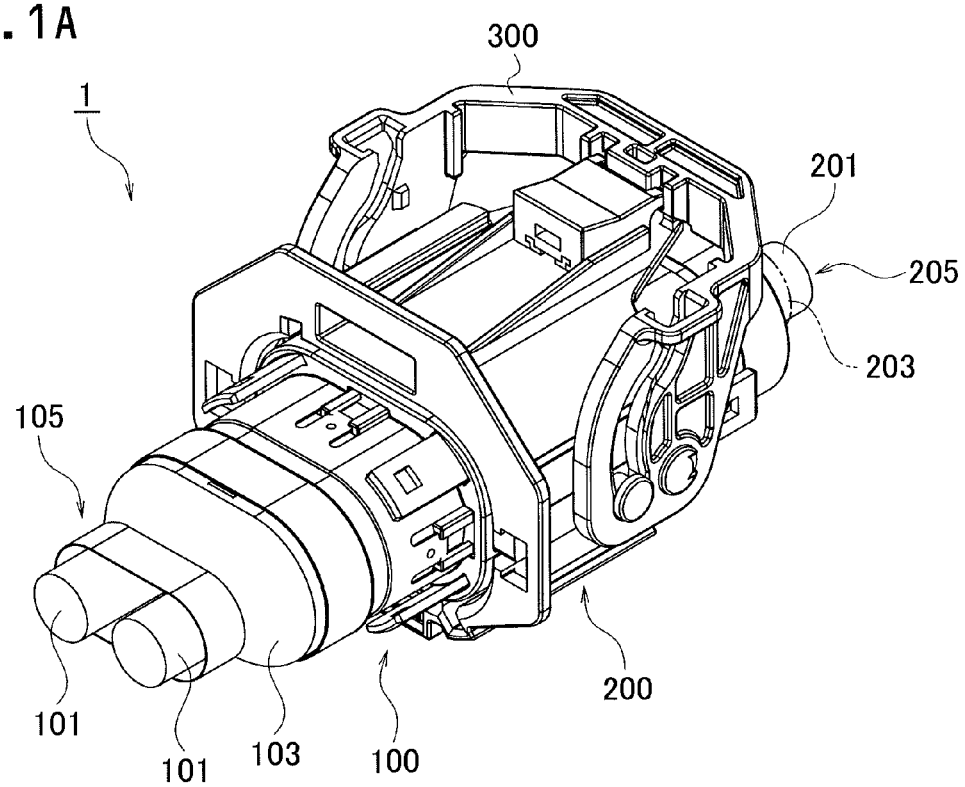
FIG. 1A is a perspective view of a shield connector according to an exemplary embodiment of the present invention, viewed from a male connector side.

Hereinafter, a connector according to an exemplary embodiment of the present invention will be described referring to the drawings. In the description of the following drawings, the same or similar reference numerals or sings are added to the same or similar portions. However, it should be noted that the drawings are schematic and therefore ratios and the like of dimensions are different from those of actual ones.

Thus, specific dimensions and the like should be determined referring to the following descriptions. Further, different dimensional relations or different dimensional ratios between the drawings may be included.

Figure 1B:
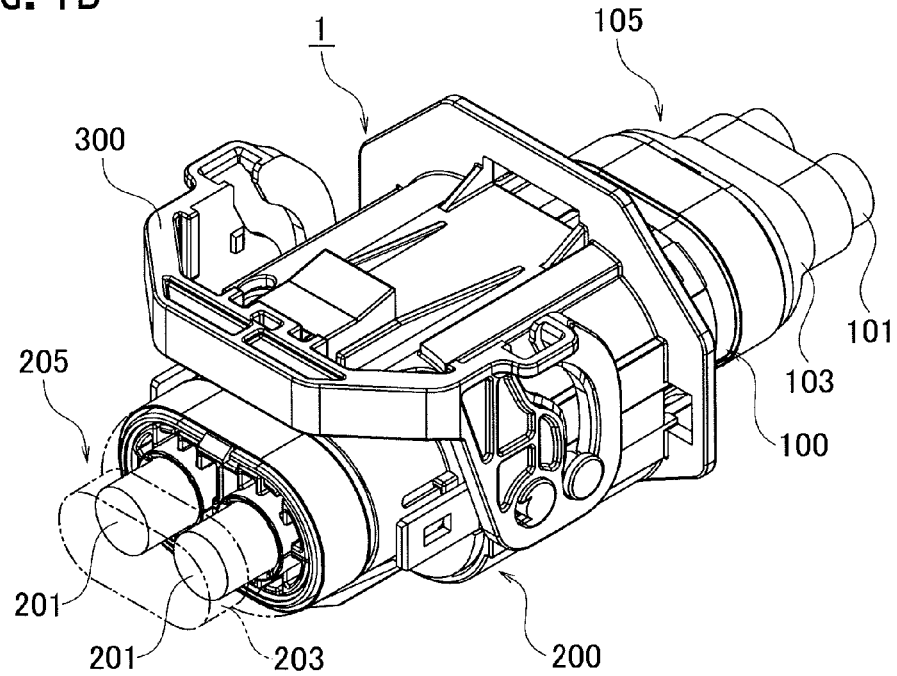
FIG. 1B is a perspective view of the shield connector according to the exemplary embodiment of the present invention, viewed from a female connector side.

FIGS. 1A and 1B are each a perspective view of a shield connector according to the exemplary embodiment of the present invention. A shield connector 1 of the present embodiment shown in FIGS. 1A and 1B has a male connector 100 and a female connector 200 respectively connected to terminals of multiple-core shield cables 105, 205. The shield connector 1 of the present embodiment constitutes a low inserting force connector (LIF connector). Thus, rotating a lever 300 of the female connector 200 can mate and separate the male connector 100 with and from the female connector 200 by a low operational force. FIG. 1 shows a state in which the male connector 100 is mated with the female connector 200.

In the following description, an extending direction of the multiple-core shield cables 105, 205 is referred to as "longitudinal direction" of the shield connector 1 (male connector 100 and female connector 200). Especially, in the male connector 100, a mating side (near side in FIG. 2A) at which the male connector 100 and the female connector 200 are mated with each other is referred to as "front side" while a separating side (back side in FIG. 2A or a side at which the male connector 100 is connected with the multiple-core shield cable 105) opposite to the front side is referred to as "rear side." Likewise, in the female connector 200, a mating side (near side in FIG. 4A) at which the male connector 100 and the female connector 200 are mated with each other is referred to as "front side" while a separating side (back side in FIG. 4A or a side at which the female connector 200 is connected with the multiple-core shield cable 205) opposite to the front side is referred to as "rear side."

Figure 2A:
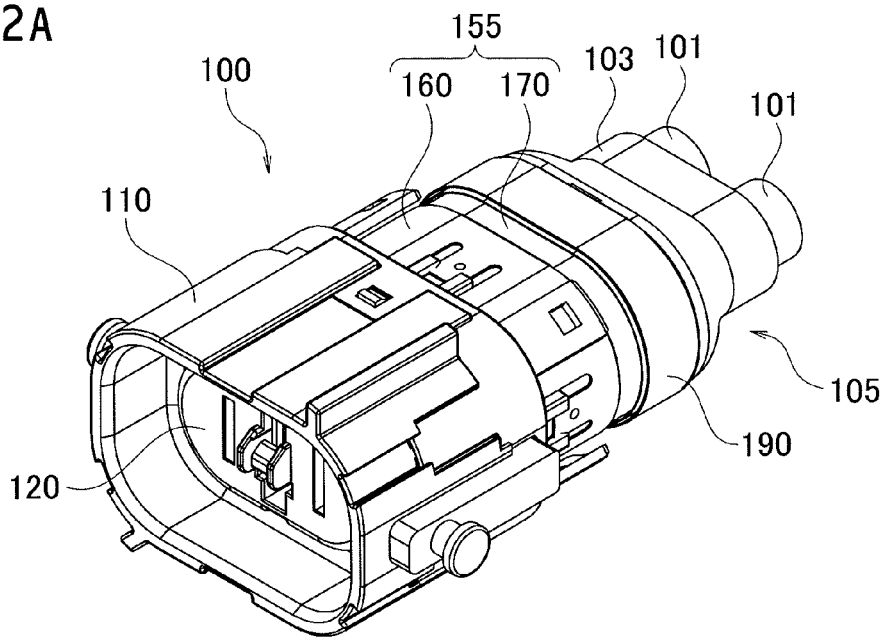
FIG. 2A is a perspective view of the male connector viewed from a mating side of the male connector, according to the exemplary embodiment of the present invention.
Figure 2B:
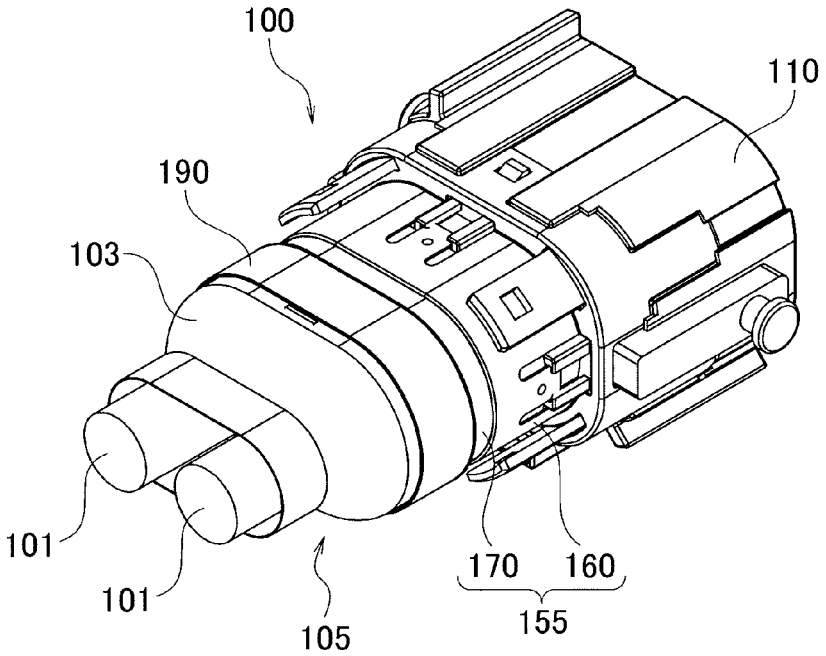
FIG. 2B is a perspective view of the male connector viewed from a separating side of the male connector, according to the exemplary embodiment of the present invention.

As shown in FIGS. 2A and 2B, the male connector 100 has a male housing 110 (housing) made of insulating resin and a conductive shell 155. As detailed below, a braided wire 103 for covering two electric wires 101, 101 of the multiple-core shield cable 105 is connected to the conductive shell 155. Detailed structure of the conductive shell 155 will be described below.

Figure 3:
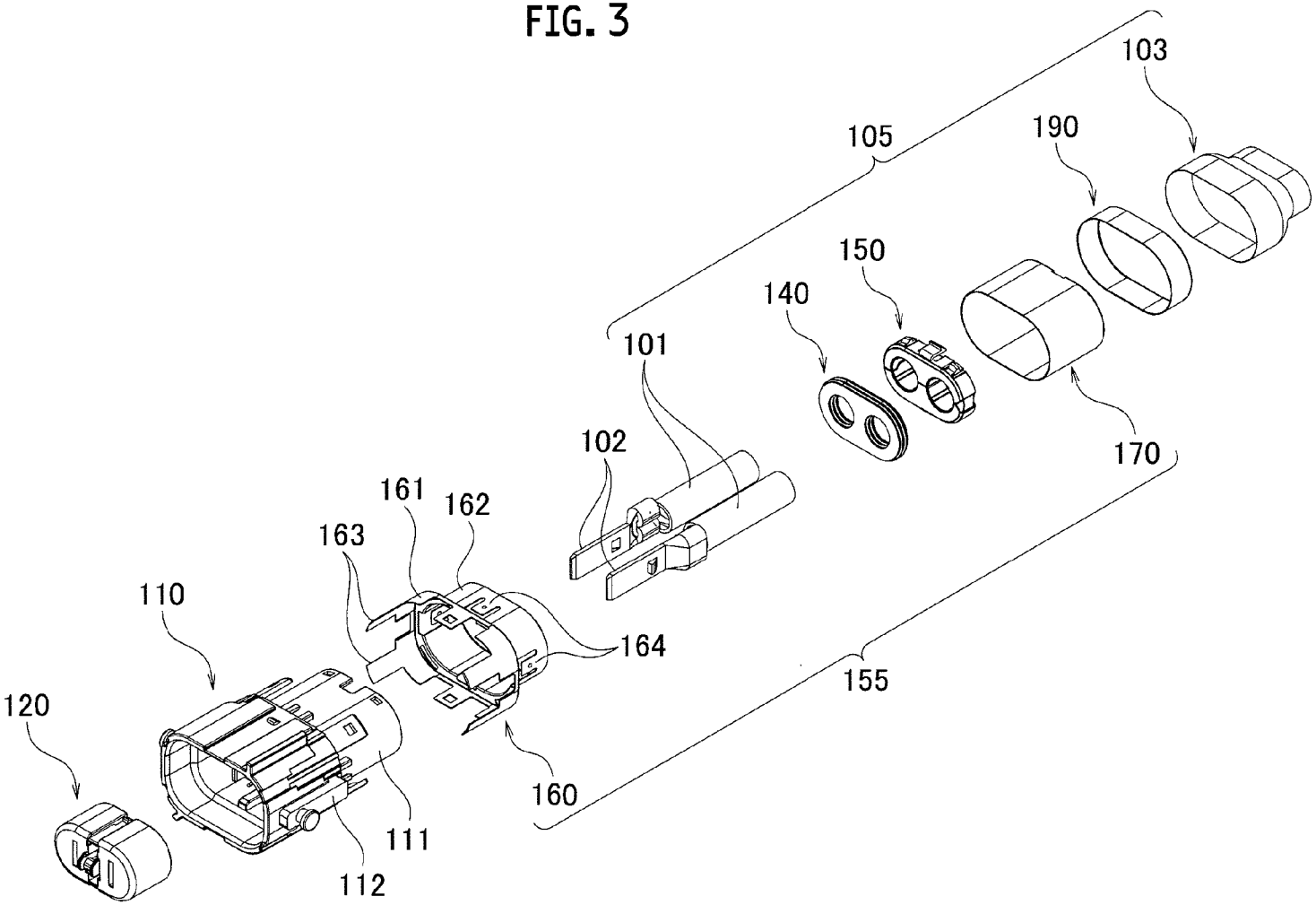
FIG. 3 is an exploded perspective of the male connector, according to the exemplary embodiment of the present invention.

As shown in FIG. 3, the male housing 110 has a double structure, that is, a cylindrical inner housing 111 and a cylindrical outer housing 112. Male terminals 102, 102 (terminals) connected respectively to the electric wires 101, 101 are inserted into the inner housing 111 from the rear side.

A moving plate 120 adapted to move forward and rearward in the longitudinal direction in the inner housing 111 works to prevent the male terminals 102, 102 from being exposed to an opening of the male housing 110 when the male connector 100 is not mated with the female connector 200. When the male connector 100 is mated with the female connector 200, the moving plate 120 is released from the restriction of movement relative to the inner housing 111 and thus moves rearward. Thus, the male terminals 102, 102 are exposed to the opening of the male housing 110 to thereby make it possible to connect the male terminals 102, 102 with the female terminals 202, 202 of the female connector 200 (refer to FIG. 5).

A rubber plug 140 and a rear holder 150 are received in a braided wire fixing member 170. In the braided wire fixing member 170, the rear holder 150 positions the electric wires 101, 101 in positions corresponding to an interval between the male terminals 102, 102. The rubber plug 140 plugs a gap between the braided wire fixing member 170 and the electric wires 101, 101, to thereby implement a water-proof sealing in the male housing 110.

Figure 4A:
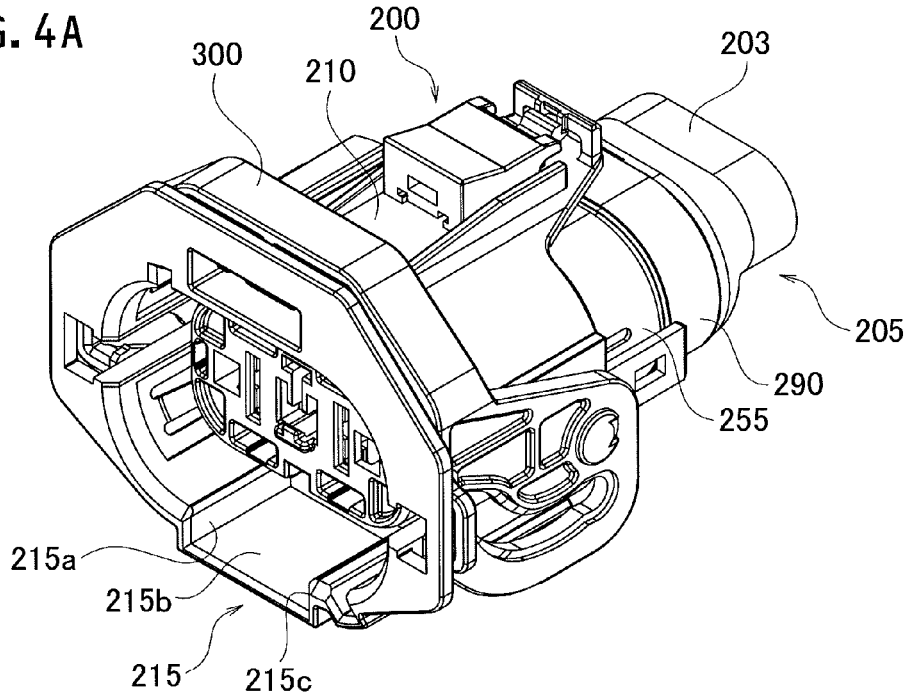
FIG. 4A is a perspective view of the female connector viewed from a mating side of the female connector, according to the exemplary embodiment of the present invention.
Figure 4B:
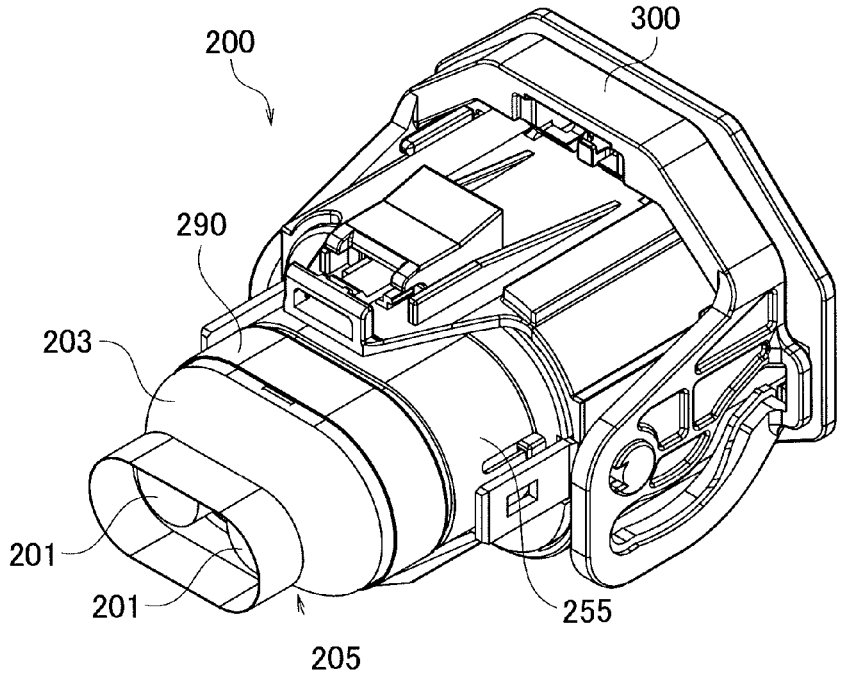
FIG. 4B is a perspective view of the female connector viewed from a separating side of the female connector, according to the exemplary embodiment of the present invention.

As shown in FIGS. 4A and 4B, the female connector 200 has a female housing 210 (housing) made of insulating resin and a conductive shell 255. As detailed below, a braided wire 203 for covering two electric wires 201, 201 of the multiple-core shield cable 205 is connected to the conductive shell 255. Detailed structure of the conductive shell 255 will be described below.

Figure 5:
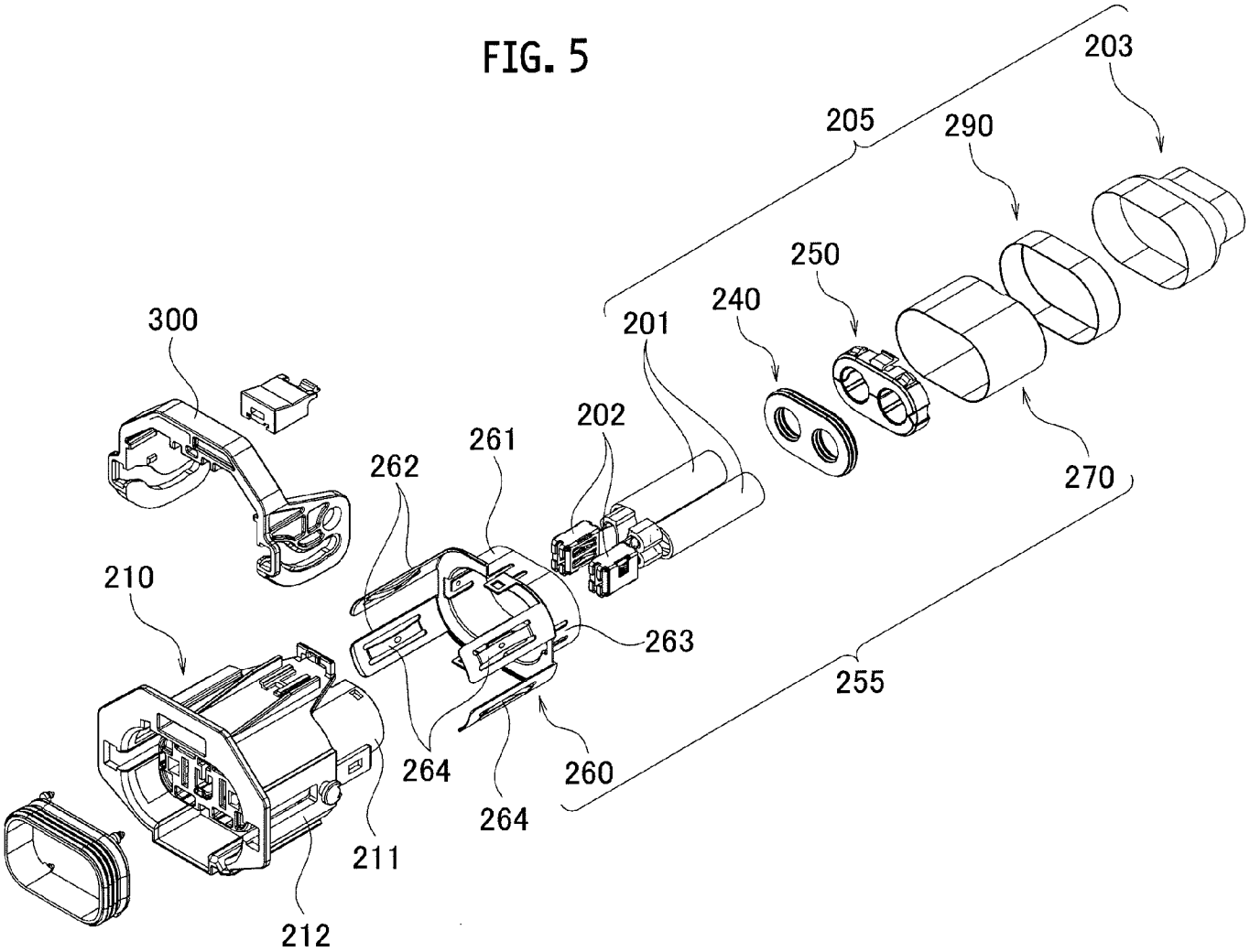
FIG. 5 is an exploded perspective of the female connector, according to the exemplary embodiment of the present invention.

As shown in FIG. 5, the female housing 210 has a double structure, that is, a cylindrical inner housing 211 and a cylindrical outer housing 212. Female terminals 202, 202 (terminals) connected respectively to the electric wires 201, 201 are inserted into the inner housing 211 from the rear side. The female terminals 202, 202 are exposed to an opening of the female housing 210. When the male connector 100 is mated with the female connector 200, the female terminals 202, 202 are connected with the male terminals 102, 102 of the male connector 100 (refer to FIG. 3).

A rubber plug 240 and a rear holder 150 are received in a braided wire fixing member 270. In the braided wire fixing member 270, the rear holder 250 positions the electric wires 201, 201 in positions corresponding to an interval between the female terminals 202, 202. The rubber plug 140 plugs a gap between the braided wire fixing member 270 and the electric wires 201, 201, to thereby implement a water-proof sealing in the female housing 210.

Next, detailed structure of each of the conductive shell 155 of the male connector 100 and the conductive shell 255 of the female connector 200 will be described. As shown in FIG. 3, the conductive shell 155 of the male connector 100 includes two members, that is, the shell body 160 and the braided wire fixing member 170. Further, as shown in FIG. 5, the conductive shell 255 of the female connector 200 includes two members, that is, a shell body 260 and the braided wire fixing member 270.

Detailed structure of the conductive shell 255 of the female connector 200 will be described referring to FIGS. 6A and 6B.

Figure 6A:
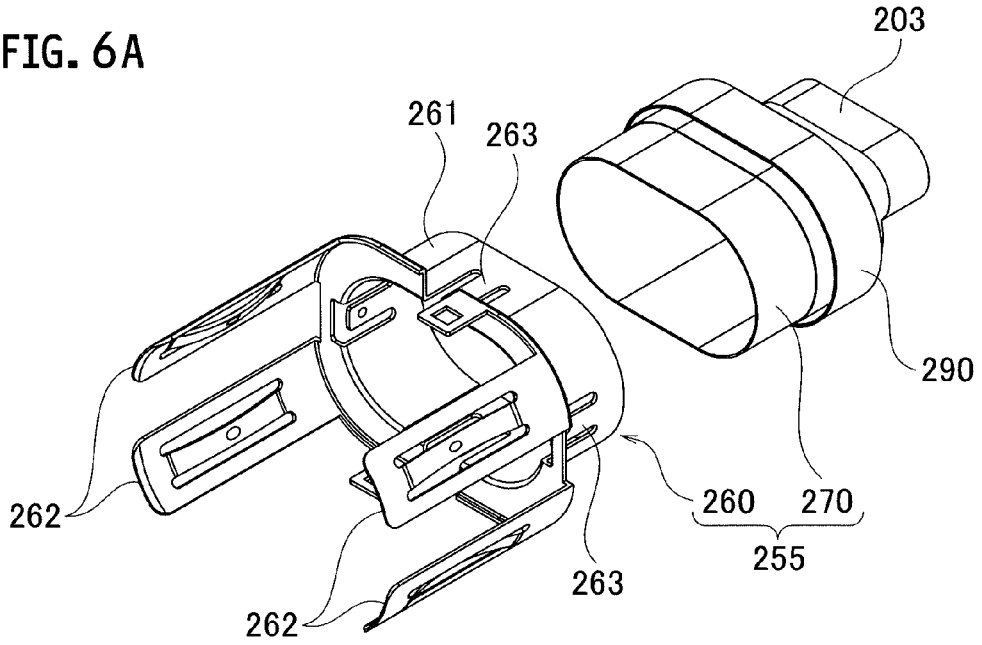
FIG. 6A is an enlarged perspective view of a separated state of a shell of the female connector, according to the exemplary embodiment of the present invention.

As shown in FIG. 6A, the shell body 260 of the conductive shell 255 of the female connector 200 is formed into a step by a cylindrical portion 261 (fixing member mating portion) and a plurality of terminal pieces 262 each extending in a form of an L-letter shape from the cylindrical portion 261. Each terminal piece 262 is inserted into a gap between the inner housing 211 and the outer housing 212 of the female housing 210 and is exposed in the female housing 210. The cylindrical portion 261 covers a rear side portion of the inner housing 211.

The braided wire fixing member 270 has a cylindrical configuration which is matable with an inner periphery of the cylindrical portion 261 of the shell body 260. As shown in FIG. 6B, when the braided wire fixing member 270 is mated with the inner periphery of the cylindrical portion 261, a plurality of spring contacts 263 (contact) of the cylindrical portion 261 elastically abut an outer peripheral face of the braided wire fixing member 270, to thereby bring the cylindrical portion 261 and the braided wire fixing member 270 into an electrically conductive state. The braided wire 203 of the multiple-core shield cable 205 is crimped and fixed to the braided wire fixing member 270 by mating a braided wire crimping member 290 with the outer peripheral face of the braided wire fixing member 270.

Detailed structure of the conductive shell 155 of the male connector 100 will be described referring to FIG. 3. As shown in FIG. 3, the shell body 160 of the conductive shell 155 of the male connector 100 is formed into a step by a large diameter portion 161 on the front side and a small diameter portion 162 on the rear side (fixing member mating portion). A distal end of the large diameter portion 161 is inserted into a gap between the inner housing 111 and outer housing 112 of the male housing 110 and a remaining portion of the large diameter portion 161 covers the exposed outer peripheral face of the inner housing 111. The small diameter portion 162 covers a rear side portion of the inner housing 111. The large diameter portion 161 has a plurality of terminal portions 163 connectable with the plurality of terminal pieces 262 of the female connector 200.

The braided wire fixing member 170 has a cylindrical configuration which is matable with an inner periphery of the small diameter portion 162 of the shell body 160. When the braided wire fixing member 170 is mated with the inner periphery of the small diameter portion 162, a plurality of spring contacts 164 (contact) of the small diameter portion 162 elastically abut an outer peripheral face of the braided wire fixing member 170 to thereby bring the small diameter portion 162 and the braided wire fixing member 170 into an electrically conductive state. The braided wire 103 of the multiple-core shield cable 105 is crimped and fixed to the braided wire fixing member 170 by mating a braided wire crimping member 190 with the outer peripheral face of the braided wire fixing member 170.

Next, a procedure for assembling the shell 155 of the male connector 100 and the shell 255 of the female connector 200 will be described. Herein, also described is a procedure for mounting the shell body 160 of the shell 155 to the male housing 110 and a procedure for mounting the shell body 260 of the shell 255 to the female housing 210.

Although the shell 155 of the male connector 100 is slightly different in structure from the shell 255 of the female connector 200, the assembling procedures of the two are substantially the same. Thus, a description will be made firstly about the assembly of the shell 255 of the female connector 200, on behalf of the two.

Figure 6B:
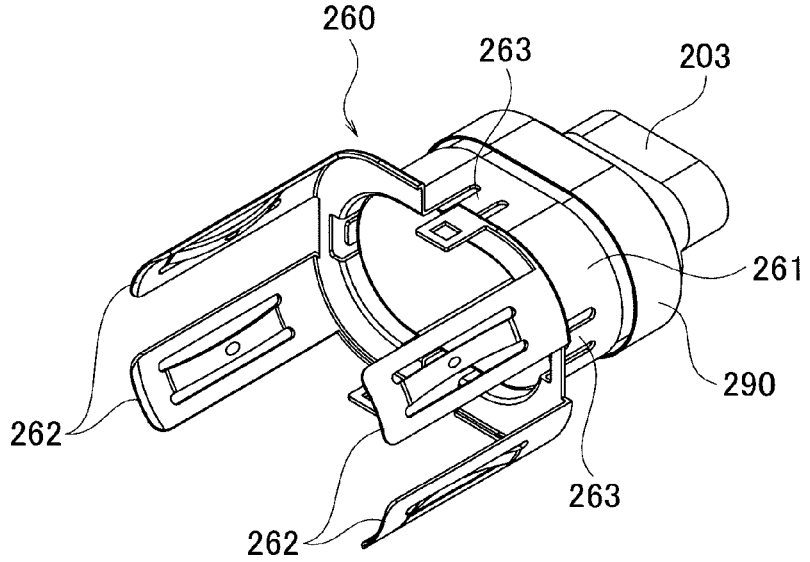
FIG. 6B is an enlarged perspective view of a mated state of the shell of the female connector, according to the exemplary embodiment of the present invention.

For ease of understanding of the structural relation between the shell body 260 and the braided wire fixing member 270, FIGS. 6A and 6B show a state in which the shell body 260 is separated from the female housing 210. Thus, FIG. 6B shows a state in which the braided wire fixing member 270 to which the braided wire 203 is crimped and fixed is mated with the cylindrical portion 261 before being mounted to the female housing 210.

However, in the actual assembly, it is preferable that the cylindrical portion 261 of the shell body 260 be inserted to between the inner housing 211 and outer housing 212 of the female housing 210 and then the braided wire fixing member 270 to which the braided wire 203 is crimped and fixed be mated with the cylindrical portion 261 of the shell body 260 that is integrated with the female housing 210.

Assembling the female connector 200 in the above procedure can eliminate the need for making a delicate inserting operation of inserting the shell body 260 into a slight gap between the inner housing 211 and outer housing 212 of the female housing 210 while enduring a weight of the multiple-core shield cable 205 in a state in which the shell body 260 is connected with the multiple-core shield cable 205 via the braided wire 203.

By this, the light-weight shell body 260 alone can accomplish the mounting to the female housing 210 which mounting needs to be implemented without causing a damage such as flexural deformation to the shell body 260.

Further, in crimping and fixing the braided wire 203 to the braided wire fixing member 270, since the inner housing 211 of the female housing 210 is not present inside the braided wire fixing member 270, it can be made possible that the crimping force is not transmitted, as a stress, to the inner housing 211 via the braided wire fixing member 270.

With respect to the assembly procedure of the shell 155 of the male connector 100, for the reason same as that in the case of the shell 255 of the female connector 200, it is preferable that the small diameter portion 162 of the shell body 160 be inserted to between the inner housing 111 and outer housing 112 of the male housing 110 and then the braided wire fixing member 170 to which the braided wire 103 is crimped and fixed be mated with the small diameter portion 162 of the shell body 160 that is integrated with the male housing 110.

Figure 7:
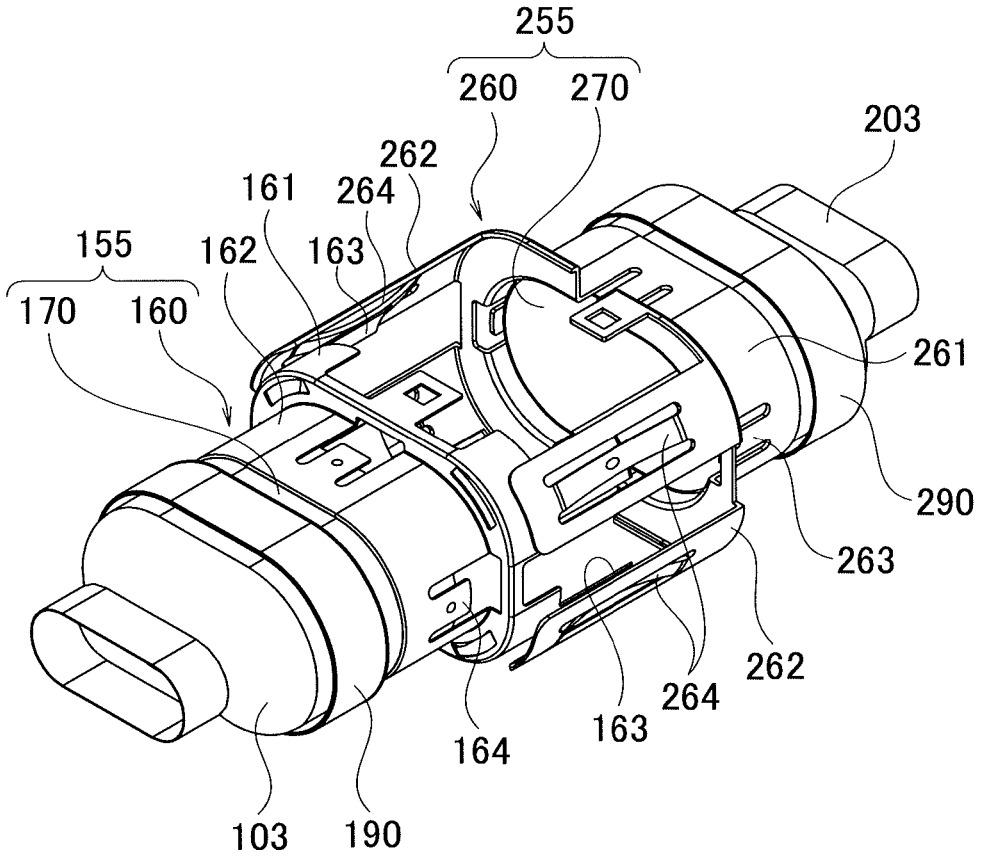
FIG. 7 is an enlarged perspective view of a connection state of the shell of the female connector and the shell of the male connector with the male connector mated with the female connector, according to the exemplary embodiment of the present invention.

Then, with the male connector 100 mated with the female connector 200, the shells 155, 255 mounted respectively to the male housing 110 and female housing 210 give the positional relation as shown in FIG. 7. For a good visibility, only the shells 155, 255 are shown in FIG. 7.

Mating the male connector 100 with the female connector 200 allows such that each of the terminal portions 163 formed at the shell body 160 of the shell 155 of the male connector 100 is so disposed as to oppose the inside of one of the terminal pieces 262 formed at the shell body 260 of the shell 255 of the female connector 200. Then, a spring contact 264 of each of the terminal pieces 262 elastically abuts one of the opposing terminal portions 163, to thereby bring the shell body 160 of the shell 155 and the shell body 260 of the shell 255 into an electrically conductive state.

With the shield connector 1 having the above structure, the shell 155 of the male connector 100 includes two parts, that is, the shell body 160 to be integrated with the male housing 110 and the braided wire fixing member 170 to which the braided wire 103 of the multiple-core shield cable 105 is crimped and fixed. Likewise, the shell 255 of the female connector 200 includes two parts, that is, the shell body 260 to be integrated with the female housing 210 and the braided wire fixing member 270 to which the braided wire 203 of the multiple-core shield cable 205 is crimped and fixed.

Thus, it is not necessary to mount the shell body 160 to the male housing 110 while enduring the weight of the multiple-core shield cable 105 in a state in which the shell body 160 is connected with the multiple-core shield cable 105 via the braided wire 103. Likewise, it is not necessary to mount the shell body 260 to the female housing 210 while enduring the weight of the multiple-core shield cable 205 in a state in which the shell body 260 is connected with the multiple-core shield cable 205 via the braided wire 203. Thus, each of the light-weight shell body 160 and the light-weight shell body 260 alone can accomplish the mounting which needs to be implemented without causing a damage such as flexural deformation to the terminal portion 163 of the shell body 160 and the terminal piece 262 of the shell body 260.

Further, with the braided wire fixing member 170 separated from the male housing 110 such that no stress is applied to the male housing 110 at the time of crimping and fixing the braided wire 103, the braided wire 103 can be crimped and fixed to the braided wire fixing member 170 without using a core. Likewise, with the braided wire fixing member 270 separated from the female housing 210 such that no stress is applied to the female housing 210 at the time of crimping and fixing the braided wire 203, the braided wire 203 can be crimped and fixed to the braided wire fixing member 270 without using a core. Further, thereafter, mating the braided wire fixing member 170 (which is connected with the multiple-core shield cable 105) with the small diameter portion 162 of the shell body 160 and mating the braided wire fixing member 270 (which is connected with the multiple-core shield cable 205) with the cylindrical portion 261 of the shell body 260 can be more simplified than the conventional operation of mounting the shell to the housing since the positioning accuracy and the like to the mounting target portion can be lowered.

With the shield connector 1 having the above structure, mounting the shell 155 to the male housing 110, mounting the shell 255 to the female housing 210, crimping and fixing the braided wire 103 to the shell 155 and crimping and fixing the braided wire 203 to the shell 255 can be implemented, without deforming the male housing 110 and female housing 210 and by a simple and easy operation.

Further, according to the present embodiment, the spring contact 164 for bringing the shell body 160 and the braided wire fixing member 170 into the electrical conduction state is provided at the shell body 160 and likewise the spring contact 263 for bringing the shell body 260 and the braided wire fixing member 270 into the electrical conduction state is provided at the shell body 260, however, the spring contacts 164, 263 may be provided at the braided wire fixing members 170, 270 respectively. Further, it is permitted to provide the spring contact 164 at both the shell body 160 and the braided wire fixing member 170 and likewise to provide the spring contact 263 at both the shell body 260 and the braided wire fixing member 270. Further, the spring contacts 164, 263 may be omitted provided that the electrical conduction state between the shell bodies 160, 260 and the respective braided wire fixing members 170, 270 can be secured.

According to the present embodiment, the braided wire fixing member 170 is fitted in the shell body 160, however, the shell body 160 may be fitted in the braided wire fixing member 170. In this case, a plurality of spring contacts of the small diameter portion 162 of the shell body 160 elastically abuts an inner peripheral face of the braided wire fixing member 170 to thereby electrically connect the small diameter portion 162 to the braided wire fixing member 170.

As well, according to the present embodiment, the braided wire fixing member 270 is fitted in the shell body 260, however, the shell body 260 may be fitted in the braided wire fixing member 270. In this case, a plurality of spring contacts of the cylindrical portion 261 of the shell body 260 elastically abuts an inner peripheral face of the braided wire fixing member 270 to thereby electrically connect the cylindrical portion 261 to the braided wire fixing member 270.

Further, the present embodiment has been described by exemplifying the low insertion-force connector (LIF connector) configured to engage and separate the male connector 100 with and from the female connector 200 by rotating of the lever 300. However, the present invention can be also applied to a shield connector other than the low insertion-force connector.

This invention is extremely useful for a shield connector mounted to a terminal of a shield cable.

What is claimed is:

1. A shield connector to be mounted to a terminal of a multiple-core shield cable having a plurality of electric wires covered with a braided wire, the shield connector comprising:

a housing for receiving a terminal to be connected with a terminal of each of the electric wires; and a conductive shell mounted to the housing and to which the braided wire is to be crimped and fixed, wherein the shell includes:

a cylindrical braided wire fixing member of which a cross-section is formed into a substantial ellipse shape comprising a rubber plug configured to plug a gap between the braided wire fixing member and the plurality of electric wires, and a rear holder configured to position the plurality of electric wires in position corresponding to an interval between the terminal of each of the electric wires, a braided wire crimping member for crimping and fixing the braided wire to the braided wire fixing member, and a shell body configured to be separated from the braided wire fixing member and provided to be integrated with the housing before mated with the braided wire fixing member, the shell body having a cylindrical fixing member mating portion of which a cross-section is formed into a substantial ellipse shape and with which the braided wire fixing member is mated.

2. The shield connector according to claim 1, wherein at least one member of the braided wire fixing member and the fixing member mating portion is provided with a contact for securing an electrical conduction between the braided wire fixing member and the fixing member mating portion by elastically abutting the other member of the braided wire fixing member and the fixing member mating portion in a state that the braided wire fixing member is mated with the fixing member mating portion.

* * * * *